US008406659B2

(12) United States Patent
Koshida

(10) Patent No.: US 8,406,659 B2
(45) Date of Patent: Mar. 26, 2013

(54) IMAGE FORMING APPARATUS

(75) Inventor: Kohei Koshida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 360 days.

(21) Appl. No.: 12/822,012

(22) Filed: Jun. 23, 2010

(65) Prior Publication Data

US 2010/0329729 A1 Dec. 30, 2010

(30) Foreign Application Priority Data

Jun. 29, 2009 (JP) ..... 2009-153319

(51) Int. Cl.
*G03G 15/16* (2006.01)

(52) U.S. Cl. ..... 399/122; 399/121; 399/126

(58) Field of Classification Search ..... 399/121, 399/122, 126
See application file for complete search history.

(56) References Cited

U.S. PATENT DOCUMENTS

| | | | | |
|---|---|---|---|---|
| 5,797,068 | A * | 8/1998 | Otsuki et al. | 399/110 |
| 2007/0059036 | A1 * | 3/2007 | Yamada et al. | 399/116 |

FOREIGN PATENT DOCUMENTS

| | | | |
|---|---|---|---|
| JP | 05-035008 | A | 2/1993 |
| JP | 07-064429 | A | 3/1995 |
| JP | 2000-194245 | A | 7/2000 |
| JP | 2000-356937 | A | 12/2000 |
| JP | 2001-183881 | A | 7/2001 |
| JP | 2004-144878 | A | 5/2004 |
| JP | 2004144878 | A * | 5/2004 |
| JP | 2005-037442 | A | 2/2005 |
| JP | 2005-292612 | A | 10/2005 |
| JP | 2005-292612 | A | 10/2005 |
| JP | 2007-256837 | A | 10/2007 |
| JP | 2009-015107 | A | 1/2009 |

* cited by examiner

*Primary Examiner* — Walter L Lindsay, Jr.
*Assistant Examiner* — Benjamin Schmitt
(74) *Attorney, Agent, or Firm* — Canon U.S.A., Inc. IP Division

(57) ABSTRACT

In an apparatus including a fixing device configured to be rotated by receiving a driving force from a main body of the apparatus and a drawer configured to draw out of the main body while holding the fixing device, a storage position of the drawer is adjusted to adjust an alignment between a transfer unit and a fixing nip. With the alignment so adjusted, meshing of gears that transmit force to rotate a fixing roller from a driving source of the main body of the apparatus may deteriorate, thus causing a rotational unevenness of the fixing roller. Therefore, an alignment unit configured to adjust an alignment is provided between a fixing support member configured to support a fixing unit and a fixing driving unit driving the fixing unit and a transfer support member configured to support a support member supporting the fixing support member.

28 Claims, 11 Drawing Sheets

IMAGE FORMING APPARATUS

BACKGROUND OF THE INVENTION

1. Field of the Invention

The present invention relates to an image forming apparatus of the electrophotographic system, which can form an image on a sheet.

2. Description of the Related Art

Recently, with the advancement of downsizing of image forming apparatuses of the electrophotographic system, a distance between a transfer portion and a fixing nip of the image forming apparatus is coming to be short. In such an apparatus, when the width of a sheet in a conveying direction becomes shorter than the distance between the transfer potion and the fixing nip, the sheet lies on both the transfer portion and the fixing nip. If the axial line of a transfer member forming the transfer portion in a longitudinal direction thereof is not parallel to the generatrix of the fixing nip, the sheet may curve along the generatrix of the fixing nip. Thus, an image formed on the sheet may be distorted so that a desired printed product cannot be obtained.

Thus, Japanese Patent Application Laid-Open No. 2004-144878 discusses a configuration for adjusting an alignment (degree of parallelization) between the transfer portion and the fixing nip. In this configuration, a fixing device is fixed to a sub-housing (drawer unit), which can be drawn out of a main housing (an apparatus body). In such a configuration, a user can adjust an alignment between the secondary transfer device and the fixing device by adjusting a position in which the sub-housing is stored.

However, there is the following issue when a user adjusts the storing position of the sub-housing (drawer unit) for adjusting alignment.

A fixing roller and a pressure roller in the fixing device are rotated by receiving driving force transmitted from a drive input gear attached at a backside plate of the image forming apparatus main body. In other words, the driving force is transmitted from a driving source provided on the apparatus main body with a gear provided in the fixing device meshing with the drive input gear.

In such a configuration, when a user adjusts a storing position of the sub-housing for adjusting an alignment between the transfer device and the fixing device, meshing between the gear provided the fixing device and the drive input gear may be changed. In other words, when a user adjusts an alignment between the transfer portion and the fixing nip, the adjustment may affect a rotation speed of the fixing device. For example, tooth traces of the drive input gear provided on the main-housing side and the gear provided on the sub-housing side deviate each other. Thus, the rotational driving force for rotating the fixing device may periodically change. As a result, unevenness in the rotation speed of the fixing device may occur.

SUMMARY OF THE INVENTION

The present invention is directed to an image forming apparatus capable of preventing or reducing rotation unevenness of a fixing unit, which may occur due to alignment adjustment.

According to an aspect of the present invention, an image forming apparatus includes a bearing member configured to bear a toner image thereon, a transfer member configured to form a transfer portion opposite the bearing member and to transfer the toner image to a sheet, a fixing unit configured to nip and convey the sheet to fix the toner image, a driving source configured to rotationally driving the fixing unit, a first support member configured to support the fixing unit, a second support member configured to support the first support member and the transfer member, and an adjustment unit configured to adjust a position of the first support member relative to the second support member. The driving source is supported together with the fixing unit by the first support member.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
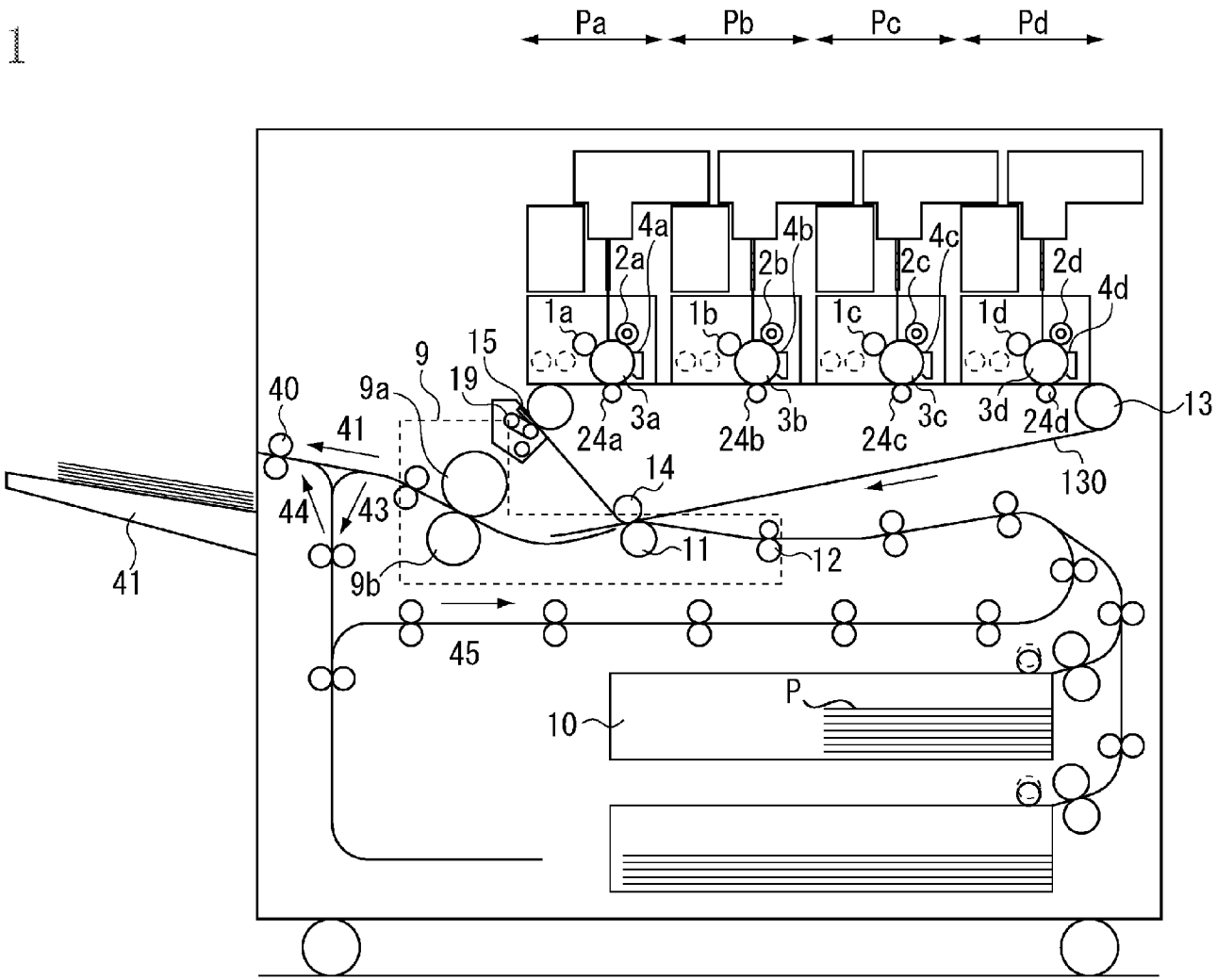
FIG. 1 illustrates a configuration of an image forming apparatus according to a first exemplary embodiment of the present invention.

FIG. 1 illustrates a configuration of an image forming apparatus according to a first exemplary embodiment of the present invention. First, second, third, and fourth image forming units Pa, Pb, Pc, and Pd are provided together in the image forming apparatus. Toner images having respective different colors are formed via latent image process, develop process, and transfer process.

These image forming units Pa, Pb, Pc, and Pd include respective image bearing members, i.e., electrophotographic photosensitive drums 3*a*, 3*b*, 3*c*, and 3*d*, to form toner images of respective colors on the respective photosensitive drums 3*a*, 3*b*, 3*c*, and 3*d*. An intermediate transfer belt (ITB) 130 is provided adjacent to the photosensitive drums 3*a*, 3*b*, 3*c*, and 3*d*. The toner images of the respective colors on the photosensitive drums 3*a*, 3*b*, 3*c*, and 3*d* are primarily transferred to the intermediate transfer belt 130, and then transferred to a recording material P (a sheet) in a secondary transfer portion. Further, the recording medium P, to which the toner images are transferred, is conveyed to a fixing unit 9. The fixing unit 9 fixes the toner images to the recording medium P by heating and pressing the toner images. Then, the recording medium P is discharged as a printed product to the outside of the apparatus. The fixing unit 9 includes a pressure roller 9*a* and a driving roller 9*b*. In addition, the fixing unit 9 can be not only a rotatable roller pair but also a belt-like fixing device on one side or a belt-like fixing device on both sides. A transfer portion is formed between the intermediate transfer belt 130, which is stretched by a secondary transfer inner roller 14, and a secondary transfer outer roller 11. In addition, in the present exemplary embodiment, the secondary transfer outer roller 11 is supported by a conveyance frame 51, which can be drawn out of the housing of the image forming apparatus.

In the first exemplary embodiment, each image forming unit has an approximately same configuration except a toner stored in a development device. Thus, a configuration of the image forming unit Pa is described as a representative. At an outer periphery of the photosensitive drum 3*a*, a drum charging device 2*a*, a development device 1*a*, a first transfer charging device 24*a*, and a cleaner 4*a* are provided, and a light source device and a polygon mirror, which are not illustrated, are provided on an upper side of the apparatus. Laser beams emitted from the light source device are converted into scanning laser beams by the rotating polygon mirror. The scanning laser beams are deflected by a reflection mirror and then focused on a generatrix of the photosensitive drum 3*a* by an f-theta lens. Accordingly, a latent image corresponding to an image signal is formed on the photosensitive drum 3*a*.

In development devices 1*a*, 1*b*, 1*c*, and 1*d*, respective toners of cyan, magenta, yellow, and black as a developer are filled at a predetermined amount by a supply device (not illustrated). The development devices 1*a*, 1*b*, 1*c*, and 1*d* develop latent images on the respective photosensitive drums 3*a*, 3*b*, 3*c*, and 3*d* and make these latent images visible as a cyan toner image, a magenta toner image, a yellow toner image, and a black toner image, respectively.

The intermediate transfer belt 130 is rotationally driven in an arrow direction at an approximately equal peripheral speed to the photosensitive drum 3. The yellow toner image formed and borne on the photosensitive drum 3*a* is transferred to an outer periphery of the intermediate transfer belt 130 at a nip portion between the photosensitive drum 3*a* and the intermediate transfer belt 130 by a primary transfer bias applied to the intermediate transfer belt 130. Further, the secondary transfer outer roller 11 is located opposite the intermediate transfer belt 130 and is arranged so as to be borne in parallel and be contacted with a back surface of the intermediate transfer belt 130. To the secondary transfer outer roller 11, a predetermined secondary transfer bias is applied by a secondary transfer bias source. The color toner image transferred to the intermediate transfer belt 130 in a superposed manner is transferred to the recording material P. More specifically, a conveyance system feeds the recoding material P from a paper supply cassette 10 to the transfer nip between the intermediate transfer belt 130 and the secondary transfer outer roller 11 at a predetermined timing through a registration roller 12 and pre-transfer guides. When the conveyance system supplies the recording material P to the transfer nip, the secondary transfer bias is simultaneously applied from the bias source. By this secondary transfer bias, the color toner image is transferred from the intermediate transfer belt 130 to the recording material P.

Similarly, a magenta toner image which is a second color, a cyan toner image which is a third color, and a black toner image which is a fourth color are transferred in order to the intermediate transfer belt 130 in a superposed manner, and a color toner image corresponding to a target color image is formed. After ending of the primary transfer, in the photosensitive drums 3*a*, 3*b*, 3*c*, and 3*d*, remaining toners are cleaned and removed by cleaners 4*a*, 4*b*, 4*c*, and 4*d*, and a next latent image forming process is prepared. The toner remaining on the intermediate transfer belt 130 and other foreign matters are swept out by contacting a cleaning web 19 (a non-woven fabric) to the surface of the intermediate transfer belt 130. The conveyance system supplies the recording material P receiving transfer of a toner image to the fixing device 9 one by one, and the fixing device 9 fixes the toner image to the recording material P by heating and pressing. Further, the recording material P after fixing is discharged to a discharge tray 41 (a stacking member) by a discharging roller pair 40.

In the image forming apparatus according to the present exemplary embodiment, a distance between the fixing nip and the transfer nip is 150 mm. Further, the maximum size of a sheet on which an image can be formed by the image forming apparatus according to the present exemplary embodiment is A3 size (297 mm×420 mm). Of course, the apparatus can form an image for a sheet of a predetermined size, such as A4 size (210 mm×297 mm), A5 size (148 mm×210 mm), B4 size (257 mm×364 mm), and B5 size (182 mm×257 mm). Further, the apparatus can similarly form an image for a free-size sheet having a size of 297 mm to 100.0 mm in the portrait direction and 420 mm to 148.0 mm in the landscape direction. In addition, an upper limit and a lower limit of the sheet size which can be designated are changed corresponding to a configuration of the image forming apparatus. In addition, when the apparatus forms an image on a sheet having a relatively small size such as postcard size (148 mm×100 mm), the sheet nipped and conveyed by the fixing device 9 is not subjected to transfer of a toner image at the transfer portion.

Figure 2B:
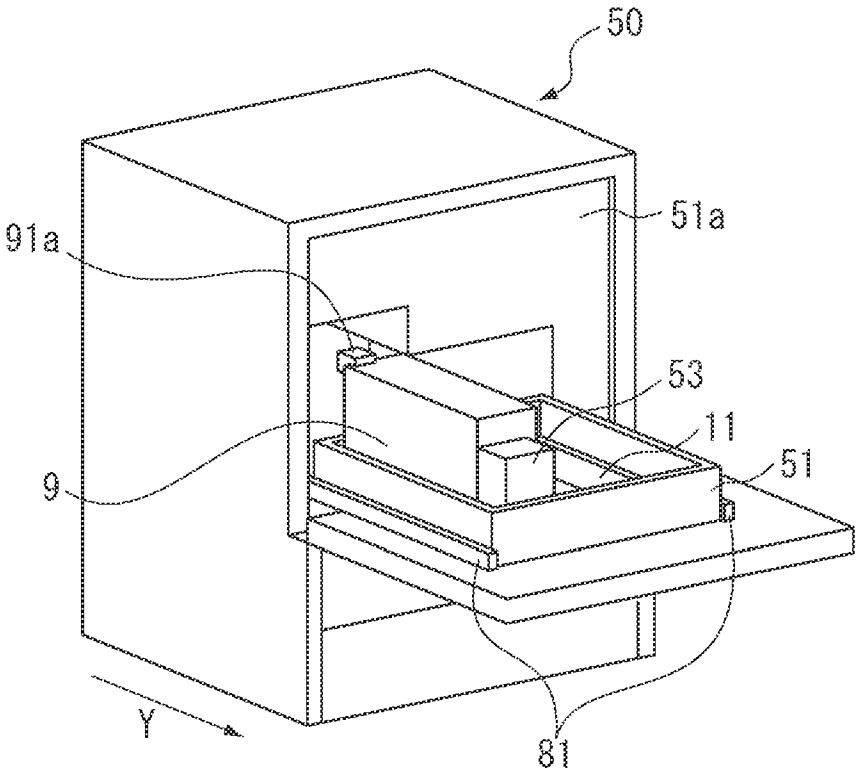
FIGS. 2A and 2B are appearance views illustrating the image forming apparatus according to the first exemplary embodiment of the present invention.
Figure 2A:
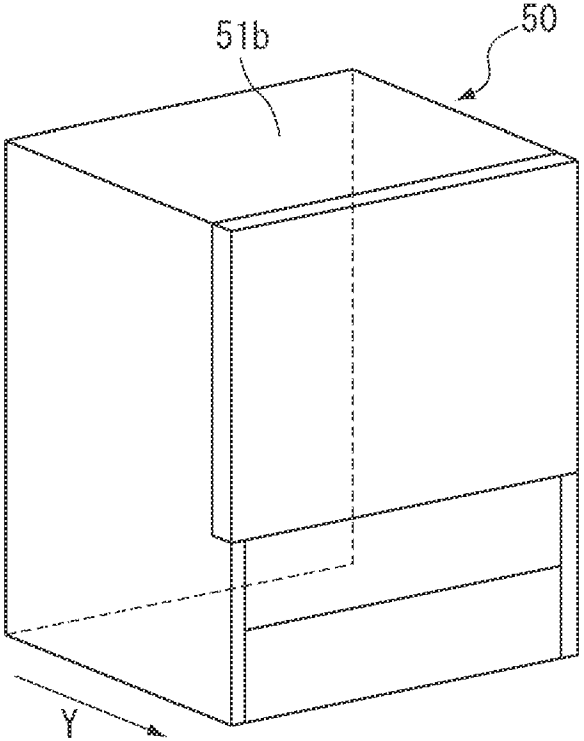

A user can draw out a portion indicated by a dotted line in FIG. 1 from the image forming apparatus. FIGS. 2A and 2B are perspective views illustrating the appearance of the image forming apparatus. FIG. 2A illustrates an appearance of the image forming apparatus when the conveyance frame 51 is stored in the apparatus main body 50. Further, FIG. 2B illustrates an appearance of the image forming apparatus when the conveyance frame 51 is drawn out of the apparatus main body 50. The conveyance frame 51 holds the fixing device 9 and the rotatable secondarily transfer outer roller 11, and can be drawn out of the apparatus main body 50. At this time, the conveyance frame 51 is guided with rails 81 provided in the apparatus main body 50 and can be drawn out in an arrow Y direction from the image forming apparatus main body 50. With such a configuration, when paper jam of the recording material P occurs in the image forming apparatus, a user can remove paper jam in the apparatus after drawing out the conveyance frame 51. Further, when a user replaces the fixing device 9, the user can easily replace the fixing device after drawing out the conveyance frame 51. Furthermore, as illustrated in FIG. 2A, the user can store, in the apparatus main body, the conveyance frame 51 by pushing in a direction opposite to the arrow Y.

Figure 3A:
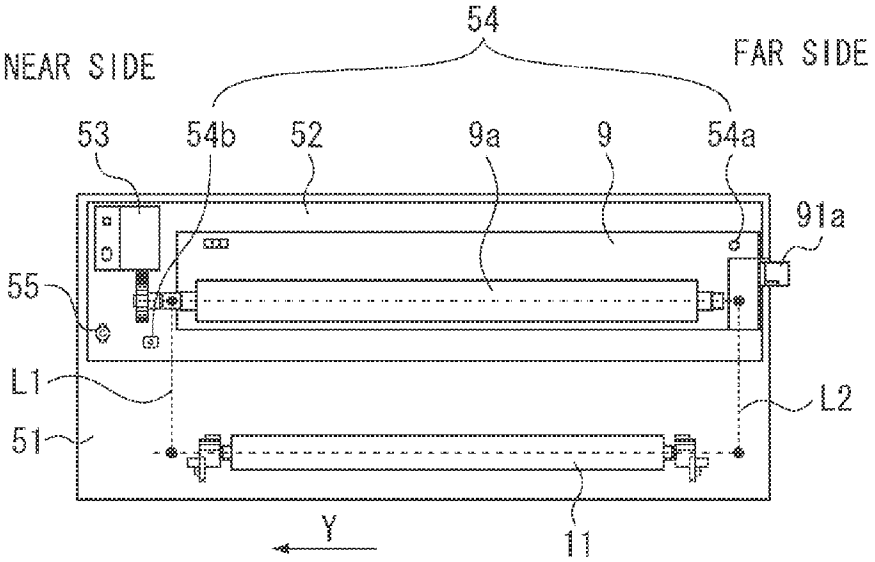
FIGS. 3A to 3C illustrate an internal configuration of a drawer unit according to the first exemplary embodiment of the present invention.
Figure 3B:
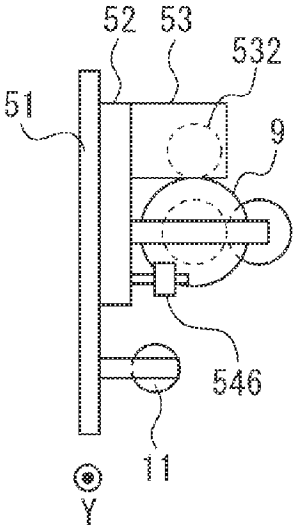
Figure 3C:
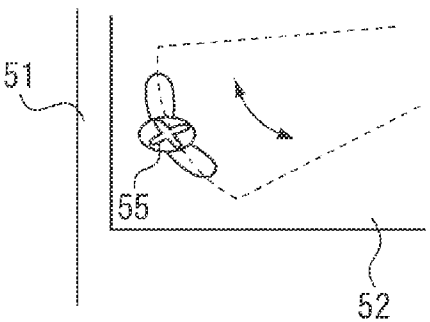
Figure 6:
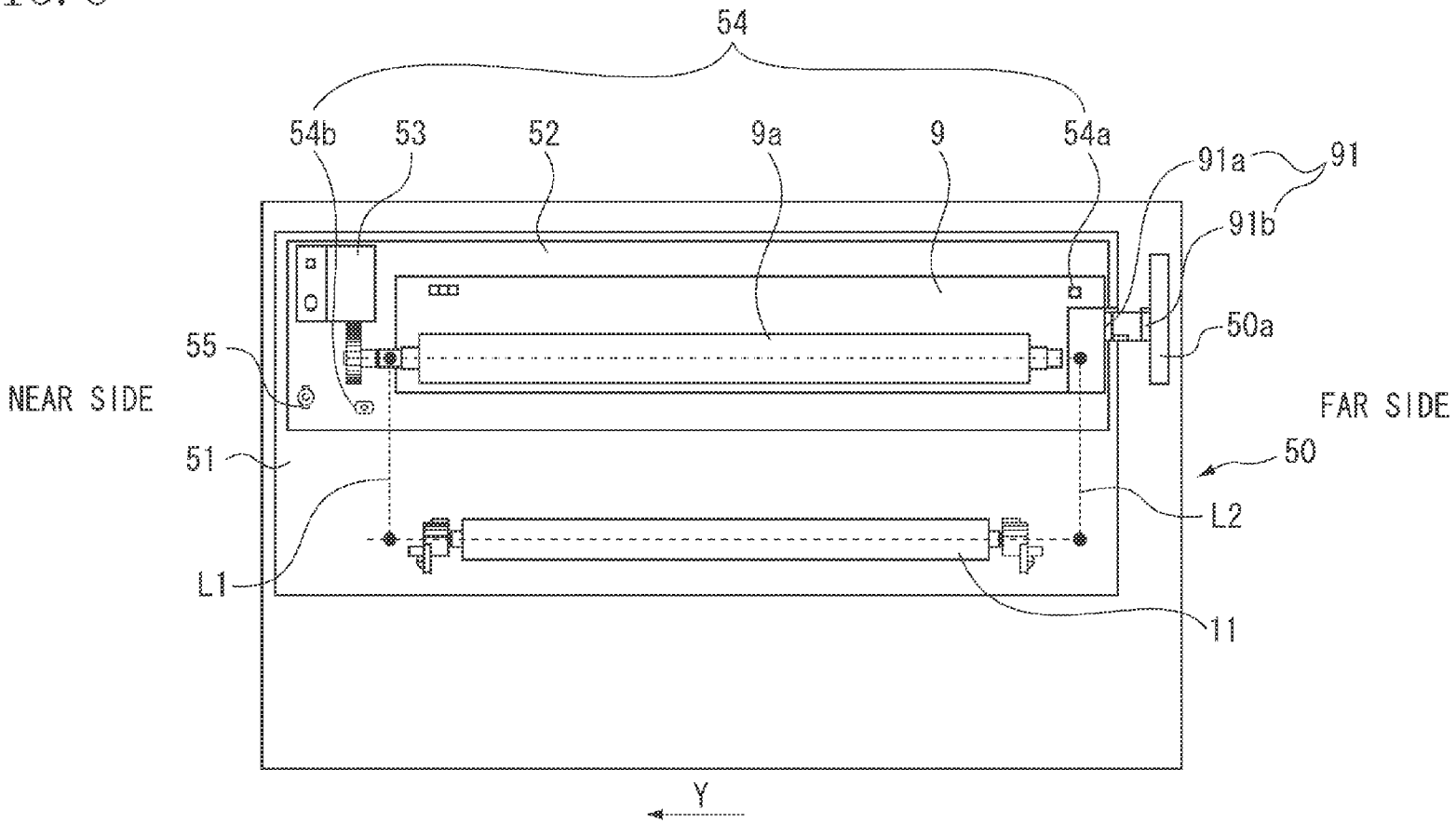
FIG. 6 illustrates a configuration when the drawer unit is connected according to the first exemplary embodiment of the present invention.

FIGS. 3A to 3C illustrate a configuration of the conveyance frame 51. FIG. 3A is a plan view of the conveyance frame 51. FIG. 3B is a side view of the conveyance frame 51. The arrow Y in FIG. 3A indicates a direction for drawing out the conveyance frame 51 from the image forming apparatus. The conveyance frame 51 directly supports the secondarily transfer outer roller 11 and a fixing support plate 52. The fixing support plate 52 supports the fixing device 9 and a motor unit 53 for driving the fixing device 9. Further, the fixing support plate 52 is able to be positioned relative to the conveyance frame 51. In addition, both the fixing device 9 and the motor unit 53 are supported by the fixing support plate 52. Therefore, if a user adjusts an attaching position of the fixing support plate 52 and the conveyance frame 51, a relative positional relationship between the fixing device 9 and the motor unit 53 is not changed. In addition, FIG. 6 illustrates a state in which the conveyance frame 51 is stored in the image forming apparatus main body 50.

Figure 4B:
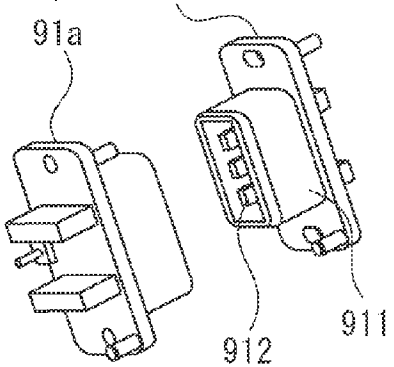
FIGS. 4A to 4C are detailed views of an adjustment portion according to the first exemplary embodiment of the present invention.
Figure 4C:
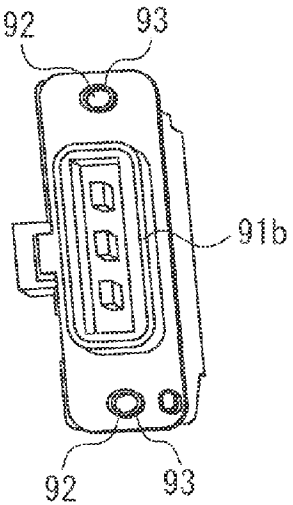
Figure 4A:
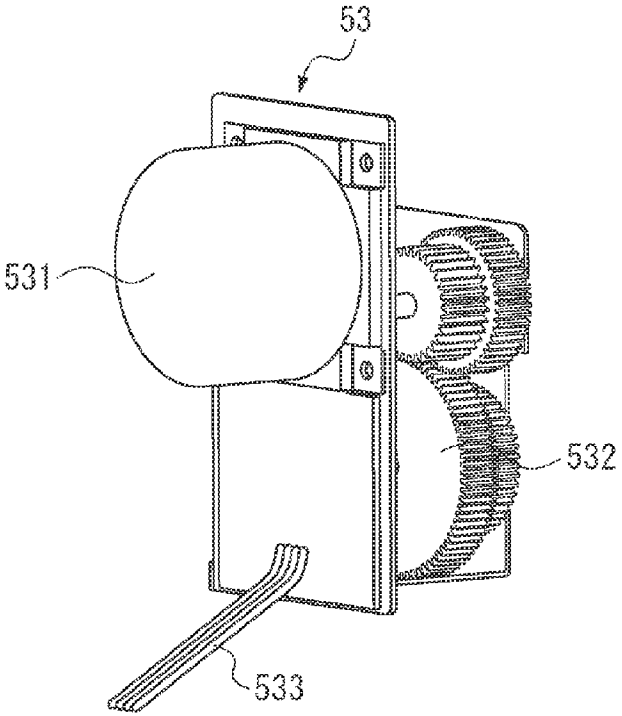

FIGS. 4A to 4C illustrate units held on the fixing support plate 52. FIG. 4A is a detailed view of the motor unit 53. The motor unit 53 includes a fixing motor 531 for generating power to be transmitted to the fixing device 9. Further, the motor unit 53 includes a gear train 532 for transmitting the driving force generated by the fixing motor 531 to the fixing device 9. The fixing motor 531 and gear train 532 are supported by a casing of the motor unit 53. A wire bundle 533 for supplying electric power to the fixing motor 531 connects to an exclusive connector with slack. The exclusive connector is provided in the conveyance frame 51 for connecting to an internal unit of the image forming apparatus main body 50. Therefore, even when a user adjusts the position of the fixing support plate 52 within a range of slack of the wire bundle 53, electric power can be supplied to the fixing motor 531.

FIG. 4B illustrates a detailed view of a power supply connector 91 as a power supply contact. The power supply connector 91 includes a housing 911 and a contact 912. In the fixing device 9, the power supply connector 91 (91*a*) is attached for supplying electric power, which is required to supply heat in the fixing device 9 from the image forming apparatus main body 50. As illustrated in FIG. 6, when the conveyance frame 51 is stored in the image forming apparatus main body 50, a connector 91*b*, which is provided at the back side plate of the housing of the image forming apparatus main body 50, connects to the connector 91*a*, which is provided in a far side of the conveyance frame 51. In addition, the back side plate is located opposed a back side surface (a back side end surface) of the conveyance frame 51 in the drawing out direction of the conveyance frame 51, which can be drawn out of the image forming apparatus main body 50. With this connection, electric power is supplied to the fixing device 9 from the power source unit (not illustrated) provided at the housing of the image forming apparatus main body 50. As illustrated in FIG. 2B, when the conveyance frame 51 is drawn out of the image forming apparatus main body 50, the connector 91*b* remains in the side of the image forming apparatus main body 50 and the connector 91*a* is drawn out outside the image forming apparatus main body 50 together with the fixing device 9.

Figure 5B:
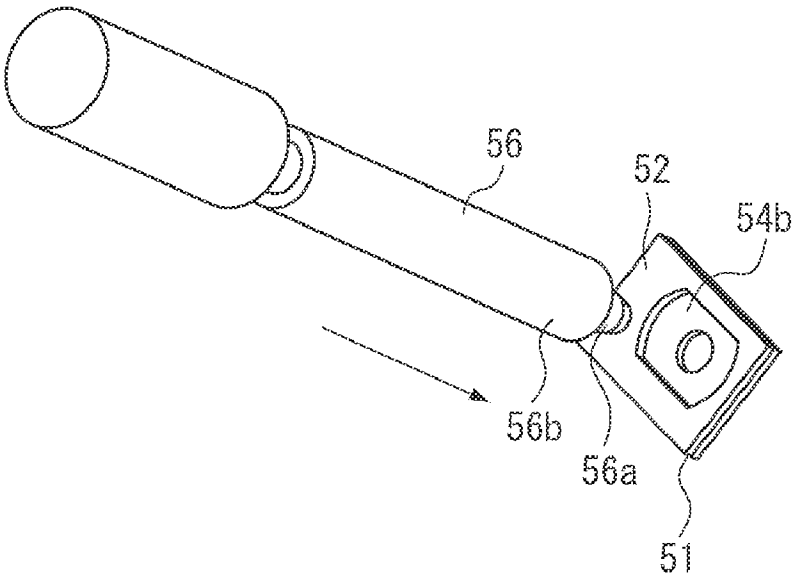
FIGS. 5A and 5B are parts view of a driving source and a power supply connector according to the first exemplary embodiment of the present invention.
Figure 5A:
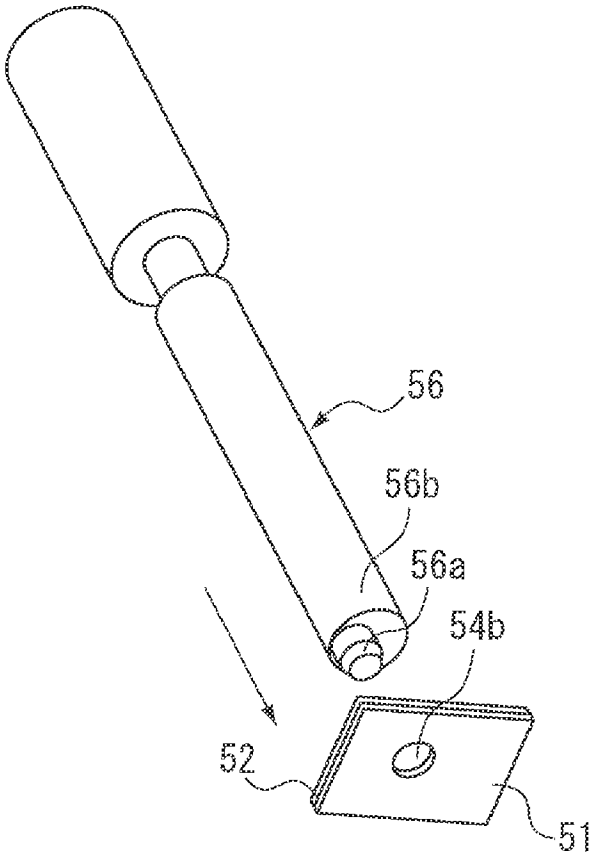

As described above, a user can adjust the position of the fixing support plate 52 relative to the conveyance frame plate 51. Then, an alignment adjusting mechanism is described in detail as follows. An alignment adjusting unit 54 can adjust a positional relationship between the fixing support plate 52 and the conveyance frame 51. The alignment adjusting unit 54 includes a rotation axis portion 54*a* and an angle adjusting portion 54*b*. The rotation axis portion 54*a* is formed by engaging a convex pin provided in the conveyance frame 51 with a concave circle hole provided in the fixing support plate 52. With this structure, the fixing support plate 52 is able to rotationally move around the rotation axis portion 54*a*. Thus, a user can adjust the position of the fixing support plate 52 relative to the conveyance frame 51. Further, it is necessary to fix the fixing the support plate 52, which can be rotationally moved to adjust the position thereof, to the conveyance frame 51. To fix the fixing support plate 52 to the conveyance frame 51, in the angle adjusting portion 54*a*, a concave hole portion is provided in the conveyance frame 51. Further, a long hole penetrating the fixing support plate 52 is provided in the fixing support plate 52. In such a structure, the user joins the fixing support plate 52 to the conveyance frame 51 by using an adjustment pin 56 as illustrated in FIGS. 5A and 5B. In this way, the user can fix a relative positional relationship between the concave hole portion provided in the conveyance frame 51 and the long hole provided in the fixing support plate 52 as the adjusted relationship. In addition, the hole provided in the conveyance frame 51 of the angle adjusting portion 54*a* can be penetrated.

FIGS. 5A and 5B illustrate an outer form of an eccentric pin 56 for joining the fixing support plate 52 and the conveyance frame 51 in the angle adjusting portion 54*b*. As illustrated in FIGS. 5A and 5B, the eccentric pin 56 includes an eccentric portion 56*a* and a rotatable portion 56*b*. As indicated in FIG. 5A, axis centers of the eccentric portion 56*a* and the rotation portion 56*b* are relatively eccentric. The eccentric portion 56*a* is fitted in the concave hole provided in the conveyance frame 51. Further, the rotatable portion 56*b* is fitted in the penetrating long hole provided in the fixing support plate 52. When a user rotates the eccentric pin 56 fitted in the hole in the conveyance frame 51 and the long hole in the fixing support plate 52, a relative positional relationship between the hole in the conveyance frame 51 and the long hole in the fixing support plate 52 is changed. By this operation, the fixing support plate 52 rotates relative to the conveyance frame 51 around the rotation axis portion 54*a*. The fixing support plate 52 rotated around the rotation axis portion 54*a* and the conveyance frame 51 are fixed with a screw 55. More specifically, as illustrated in FIG. 3C, the hole provided in the conveyance frame 51 and the arc shaped long hole provided in the fixing support plate 52 around the rotation axis portion 54*a* are fixed with the screw 55, so that the fixing support plate 52 is positioned relative to the conveyance frame 51. In addition, a user can perform adjustment by using the rotation axis portion 54*a* for positioning the fixing device 9 relative to the fixing support plate 52. An object of the alignment adjustment is for adjusting a conveyance direction of the fixing device 9 so as to be aligned with conveyance directions of the registration roller 12 and the secondary transfer outer roller 11. In this configuration, by using the aforementioned eccentric pin 56, a user can adjust the axis line of the secondary transfer outer roller 11 and the driving roller 9*a* in the fixing device 9 so as to be horizontal. In such a configuration, the processing that a user adjusts the alignment is simply described as follows. At the time of the alignment adjustment, first, the user makes the fixing support plate 52 movable by loosening the screw 55. Then, the user rotates the eccentric pin 56 so that a distance on the near side L1 and a distance on the far side L2 become equal. The distance of the near side L1 is the distance between the axial line of the secondary transfer outer roller 11 and the axial line of the driving roller 9*a* in the fixing device 9 on the near side of the conveyance frame 51, and the distance of the far side L2 is the distance between the axial line of the secondary transfer outer roller 11 and the axial line of the driving roller 9*a* in the fixing device 9 on the far side of the conveyance frame 51. When the distance L1 and the distance L2 become equal, the user joins the fixing support plate 52 to the conveyance frame 51 with the screw 55. In measuring the distance L1 and the distance L2, the user can use an exclusive tool for measuring a distance or can visually measure with a scale stamped on the conveyance plate 51. By these steps, the user performs the alignment adjustment of the fixing support plate 52 supporting the fixing device 9 and the motor unit 53 relative to the conveyance frame 51 supporting the secondary transfer outer roller 11. Thus, the relative positional relationship between the fixing device 9 and the motor unit 53 is not changed even when the user performs the alignment adjustment of the fixing device 9 and secondary transfer outer roller 11. In other words, an engagement relationship of the gears is not changed by the alignment adjustment. Therefore, the rotation unevenness of the fixing device 9 occurring by losing the engagement relationship of the gears can be prevented.

As described above, the fixing device 9 can steadily rotate with the positional relationship between the fixing support plate 52 supporting the motor unit 53 and the conveyance frame 51 adjusted.

Here, an arrangement of the power supply connector provided for steadily supplying electric power to the fixing device 9 is described in detail as follows. The power supply connector 91*a* is arranged near the rotation axis portion 54*a* in the fixing support plate 52. Since the fixing support plate 52 rotates around the rotation axis portion 54*a*, a position deviation near the rotation axis portion 54*a* can be reduced. Thus, even when the conveyance frame 51 is inserted in the image forming apparatus main body 50, the power supply connector 91*a* can be in good contact with the power supply connector 91*b* in the image forming apparatus main body 50. The rotation axis portion 54*a* is provided near one end of the fixing support plate 52 in the longitudinal direction, and the screw 55 is provided near another end of the fixing support plate 52 in the longitudinal direction. The power supply connector 91*a* is provided near one end of the fixing support plate 52 in the longitudinal direction not near another end of the fixing support plate 52.

The center of the connector 91*a* can be provided in 0 mm to 80 mm from the aforementioned cross point. FIG. 4C illustrates the power supply connector 91*b*, which is supported by a back side plate 51*b* in the main housing 51*a*, which can be drawn out in the image forming apparatus main body 50. The power supply connector 91*b* includes hole parts 93. The hole parts 93 provided in the power supply connector 91*b* are supported with predetermined backlash with respect to projection parts 92 provided in the main housing 51*a*. Therefore, when the fixing support plate 52 is rotated by adjustment and a positional relationship of the power supply connector 91*a* shifts somewhat, the backlash can absorb the shift of the power supply connector 91*a*. Thus, there is no twist of parts when the power supply connector 91*a* is inserted into the power supply connector 91*b*.

As illustrated in FIG. 3A, the angle adjustment portion 54*b* is provided on the near side of the image forming apparatus main body 50. Thus, operability of an alignment adjustment work increases by a user drawing out the conveyance frame 51.

Further, as illustrated in FIG. 3A, the motor unit 53 and the power supply connector 91 are provided opposite each other with respect to the center of a passing line of the recording material P. Thus, a space around the fixing device 9 can be used effectively. Thus, the apparatus can be small-sized by effectively using the space in the image forming apparatus main body 50. In the above-described exemplary embodiment, the configuration in which the secondary transfer outer roller 11 is held by the conveyance frame 51 is described. However, in an alternative configuration, it is only necessary that the fixing device 9 is held by the fixing support housing to the conveyance frame 51, and not necessary that the secondary transfer outer roller 11 is held by the conveyance frame 51. For example, the secondary transfer outer roller 11 can be fixed at the main body side housing.

Figure 7:
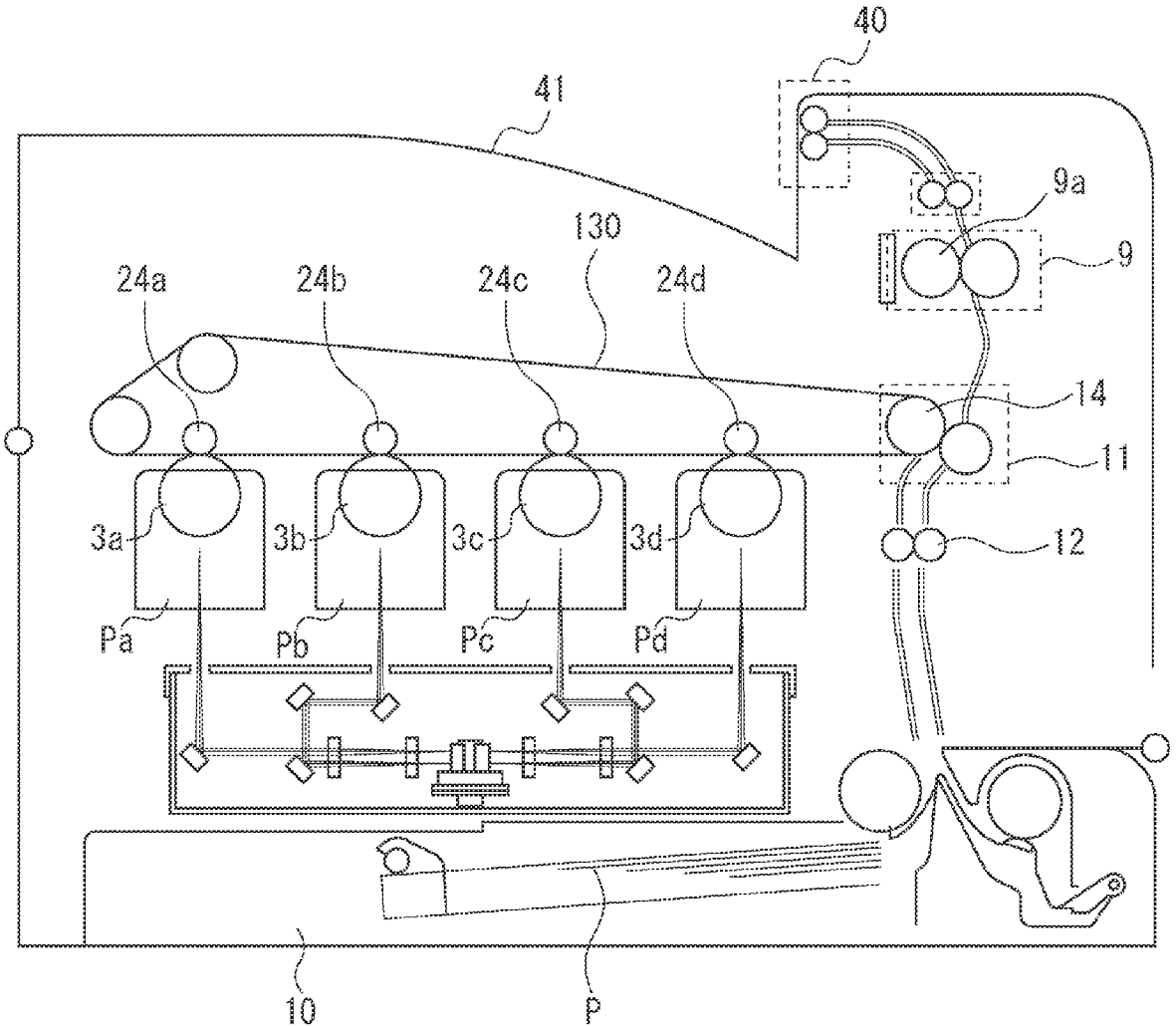
FIG. 7 illustrates a configuration of an image forming apparatus according to a second exemplary embodiment of the present invention.

FIG. 7 illustrates a configuration of an image forming apparatus according to a second exemplary embodiment of the present invention. The image forming apparatus according to the second embodiment adapts a configuration for conveying the record material P to an upper side in the gravity direction. Similar parts as in the first exemplary embodiment are assigned the same reference numerals, and the description thereof is not repeated.

Figure 8B:
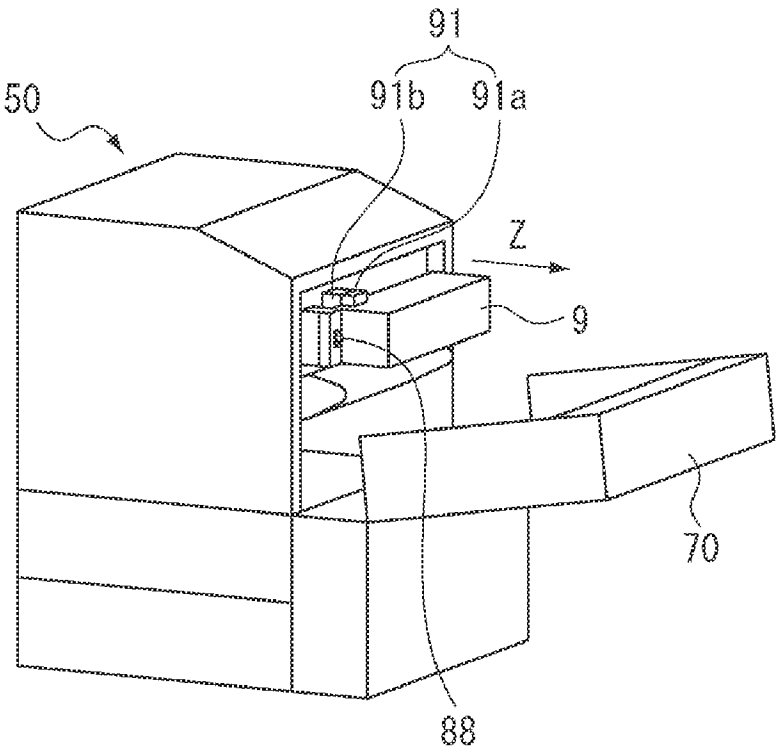
FIGS. 8A and 8B illustrate appearance views of the image forming apparatus according to the second exemplary embodiment of the present invention.
Figure 8A:
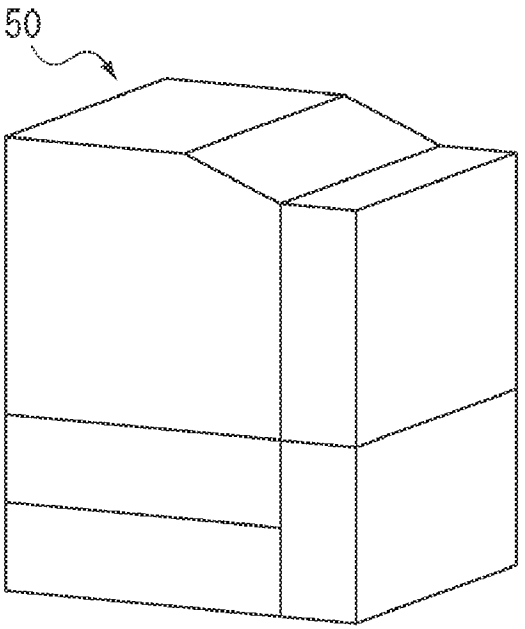
Figure 9:
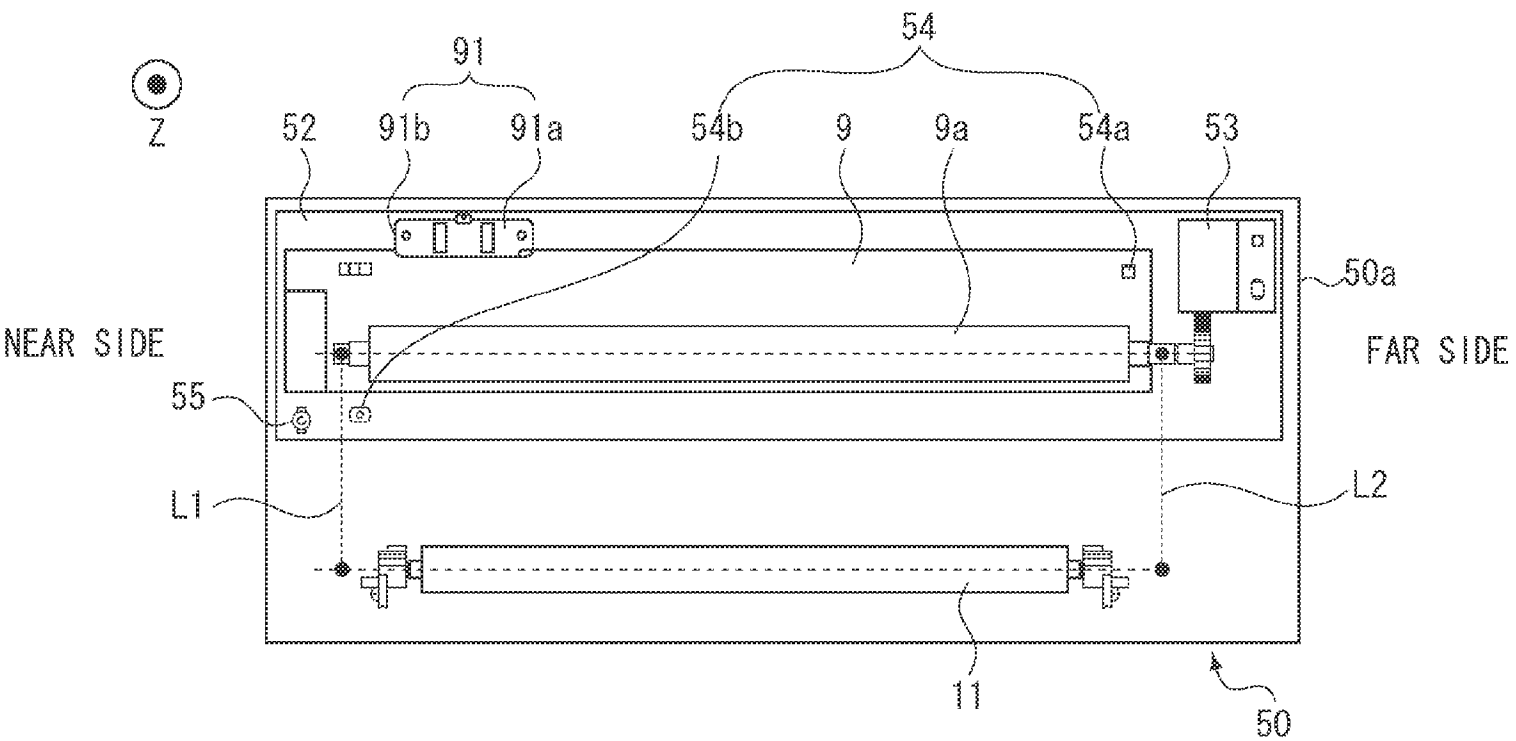
FIG. 9 illustrates a configuration around the fixing unit according to the second exemplary embodiment.

FIGS. 8A and 8B are perspective view illustrating an appearance of the image forming apparatus according to the secondary exemplary embodiment. FIG. 8A illustrates a state in which a right door 70 is closed. FIG. 8B illustrates a state in which the right door 70 is open. Similarly as in the first exemplary embodiment, when paper jam occurs in the image forming apparatus, or the fixing device 9 is to be replaced, a user opens the right door 70 to perform the required process. In the second exemplary embodiment, there is no conveyance frame 51, which can be drawn out. However, the fixing device 9 is fixed to the fixing support plate 52 similarly as in the first exemplary embodiment, and the fixing support housing is fixed to the frame of the image forming apparatus main body 50. In this configuration, the fixing device 9 is joined to the fixing support plate 52 with a screw at a lock portion 88. Thus, when a user removes the fixing device 9, the user unscrews the screw at the lock portion 88 and draws out the fixing device 9 in an arrow Z direction. In addition, the right door 70 is provided with one-side guide parts in a conveyance rout for releasing the conveyance rout, which is from the registration roller 12 to the discharge roller pair 40, as illustrated in FIG. 9, at the time of paper jam. Further, the right door 70 can be provided with a one-side roller of a roller pair used for conveying paper, such as the registration roller 12 and the secondary transfer outer roller 11.

FIG. 9 illustrates a configuration of the fixing support housing according to the second exemplary embodiment. The fixing support plate 52 supports the fixing device 9 and the motor unit 53 for driving the fixing device 9. Further, a user can adjust an alignment of the fixing device 9 and the secondary transfer outer roller 11 by adjusting a positional relationship between the fixing support plate 52 and the housing of the image forming apparatus main body 50, similarly as in the first exemplary embodiment.

Insertion or removal of the power supply connector 91 provided in the fixing device 9 in the second exemplary embodiment is performed only at the time of replacing the fixing device 9. A user replaces the fixing device 9 by removing the joining of the fixing device 9 and the fixing support plate 52. In the second exemplary embodiment, with respect to the power supply connector 91*a* on the fixing device 9, the fixing support plate 52 supports the power supply connector 91*b* on the image forming apparatus main body 50. In other words, when the fixing device 9 is removed, the connector 91*a* is detached from the connector 91*b*. Thus, when the fixing device 9 is replaced, a relative positional relationship of each power supply connector 91 is held without receiving an effect of alignment adjustment, so that contact failure can be avoided. Further, since the freedom of arrangement of the power supply connector 91 increases, downsizing of the apparatus can be advanced. In the second exemplary embodiment, the fixing device 9 is a thermal pressure fixing device that includes a halogen heater in a tubular roller. Alternatively, a fixing device using a heater of the induction heating (IH) system can be used as a configuration of the fixing device. Further, a fixing device having a belt at one side thereof can be used as a configuration of the fixing device.

In the first exemplary embodiment, the connector for supplying electric power to the fixing device 9 is integrally provided around the rotation axis portion 54*a* of the fixing support plate 52. Thus, the connector is arranged so that the position deviation of each connector is made as small as possible. The position deviation is generated by performing alignment adjustment of the fixing support plate 52 relative to the conveyance frame 51.

In such a configuration, electric power is supplied to the fixing device 9 from the connector provided on the apparatus main body side by only mounting the fixing support plate 52 on the conveyance frame 51, which can be drawn out.

However, in a third exemplary embodiment of the present invention, the following configuration is adopted for making position accuracy higher at the time of connecting the connector 91*b* provided at the back side plate of the apparatus main body housing to the connector 91*a* on the conveyance frame 51.

Figure 10A:
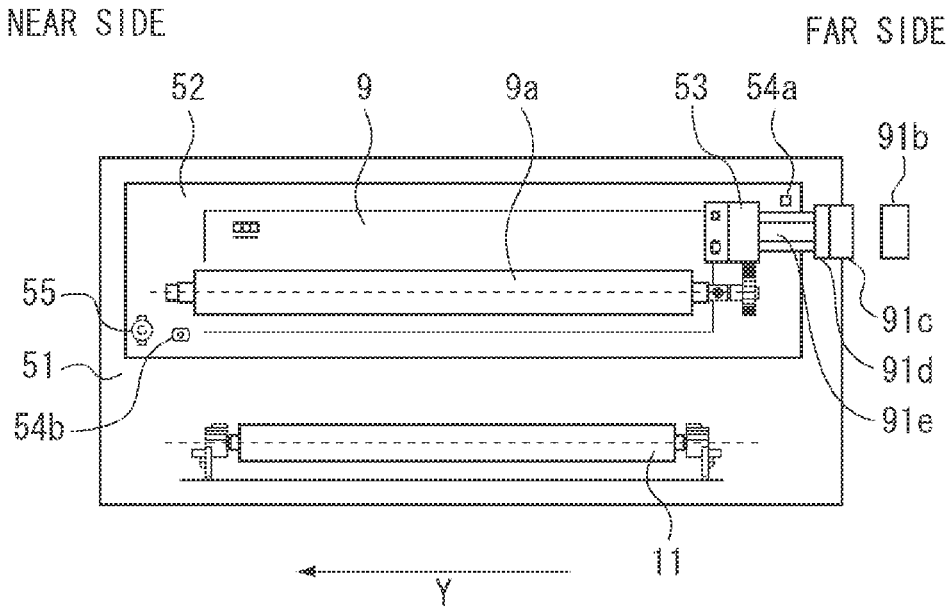
FIGS. 10A to 10C illustrate detailed parts of an adjustment portion according to the second exemplary embodiment of the present invention.
Figure 10B:
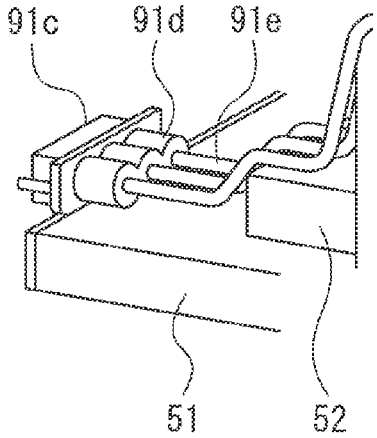
Figure 10C:
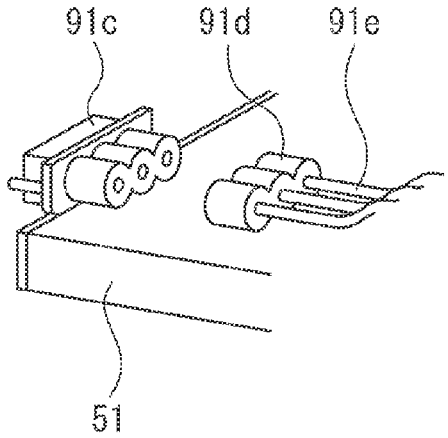

FIGS. 10A to 10C illustrate a configuration of the conveyance frame 51, which can be drawn out. FIG. 10A is a plan view of the conveyance frame 51. The main body side connector 91*b* provided at a back plate of the main body housing connects to a relay connector 91*c* fixed at the conveyance frame 51. Even when the position of the fixing support plate 52 is adjusted, a position of the relay connector 91*c* provided at the conveyance frame 51 is not changed. Therefore, the relay connector 91*c* fixed at the conveyance frame 51 can accurately connect to the power supply connector 91*b* in the apparatus main body. Here, the shape of a connection part of the relay connector 91*c* provided at the conveyance frame 51 with respect to the power supply connector 91*b* is the same as the shape in the first exemplary embodiment, and has a shape illustrated in FIG. 10B as the relay connector 91*c*. The relay connector 91*c* connects to the connector 91*b* in the apparatus main body side. Further, the relay connector 91*c* connects to a connector 91*d* connected to a wire bundle 91*e*, which is a power supply wire for supplying electric power to the fixing device 9. FIG. 10B illustrates a state in which the relay connector 91*c* connects to the connector 91*d*. Further, FIG. 10C illustrates a state in which the relay connector 91*c* is disconnected from the connector 91*d*.

The wire bundle 91*e* is connected to the relay connector 91*c* with slack between the relay connector 91*c* and the fixing device 9. In such a configuration, when a user adjusts a relative position between the fixing support plate 52 and the conveyance frame 51, the length of the wire bundle 91*e* required to connect the relay connector 91*c* and the fixing device 9 is changed. Thus, as illustrated in FIG. 10A, the wire bundle 91*e* can be arranged so as to connect the fixing device 9 and the relay connector 91*c* near the rotation axis portion 54*a* of the fixing support plate 52. With such a configuration, slack of the wire bundle 91*e* required to absorb the position deviation occurring by adjusting the position of the fixing support plate 52 relative to the conveyance frame 51 can be reduced.

With such a configuration adopted, it is necessary to connect the wire bundle 91*e* extended from the fixing device 9 to the relay connector 91*c* provided on the conveyance frame 51 each time the fixing device 9 is replaced. Further, with the arrangement illustrated in FIG. 10A, slack of the wire bundle 91*e* for rotating and driving the fixing device 9 can be also reduced.

In the first and second exemplary embodiments, the fixing device 9 includes the intermediate transfer belt and the secondary transfer outer roller. However, the fixing device for transferring an image to a sheet is not limited to the above-described configuration. For example, a toner image formed on a photosensitive drum can be transferred to a sheet at a transfer nip that is formed by a photosensitive drum and a transfer roller. Further, a transfer unit in which a non-contact corona charging device is located on aback surface side of a sheet can be used. In this case, a user can adjust an alignment so that a generatrix of the fixing nip becomes parallel to an axial line of the corona charging device in a longitudinal direction thereof.

Figure 11A:
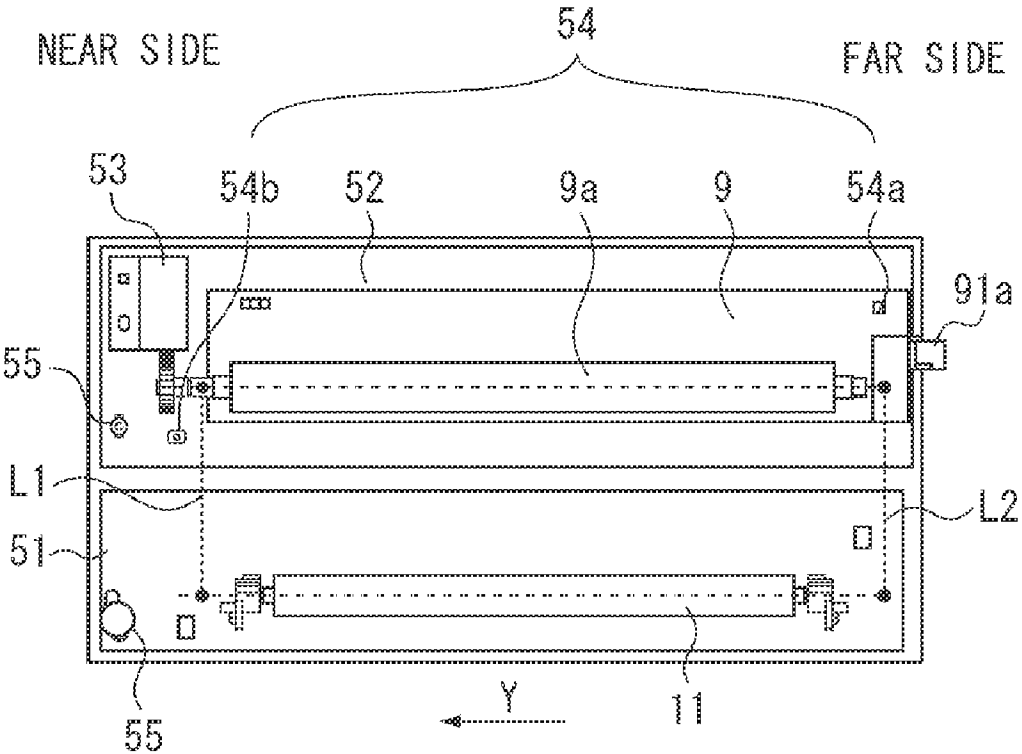
FIGS. 11A and 11B illustrate detailed views of an adjustment portion according to an exemplary embodiment of the present invention.
Figure 11B:
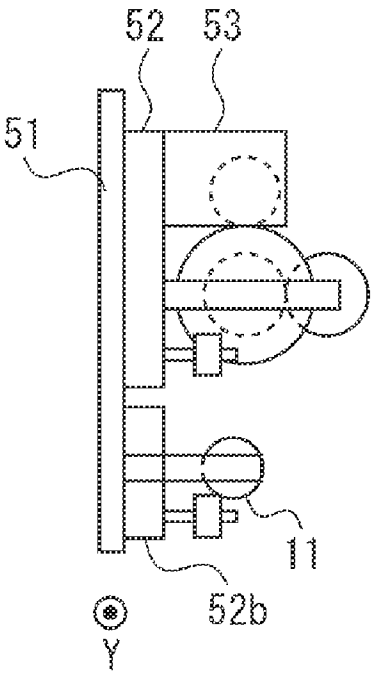

Further, a configuration for aligning generatrices of the secondary transfer outer roller and the secondary transfer inner roller can be additionally provided. FIGS. 11A and 11B illustrate a configuration for accurately aligning generatrices of the secondary transfer outer roller 11 and the secondary transfer inner roller 14. The secondary transfer outer roller 11 rotationally moves around the rotation axis similar to the fixing unit and is adjusted so as to align the generatrix of the secondary outer roller 11 with the generatrix of the secondary transfer inner roller 14.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-153319 filed Jun. 29, 2009, which is hereby incorporated by reference herein in its entirety.

What is claimed is:

1. An image forming apparatus comprising:

a bearing member configured to bear a toner image thereon;

a transfer member configured to form a transfer portion opposite the bearing member and to transfer the toner image to a sheet;

a fixing unit configured to nip and convey the sheet to fix the toner image;

a driving source configured to rotationally drive the fixing unit;

a first support member configured to support the fixing unit;

a second support member configured to support the first support member and the transfer member and draw out of a main body;

a main-body-side connector provided on a surface of the main body opposite a back end surface of the second support member in a drawing out direction;

a relay connector configured to draw out together with the second support member from the main body and configured to connect to the main-body-side connector;

a power supply wire having slack for supplying, to the fixing unit, electric power supplied to the relay connector fixed to the second support member; and an adjustment unit configured to adjust a position of the first support member relative to the second support member, wherein the driving source is supported together with the fixing unit by the first support member.

2. The image forming apparatus according to claim 1, wherein the second support member is configured to draw out of a main body, and wherein the adjustment unit is configured to adjust angles in a longitudinal direction of the transfer member and the fixing unit.

3. The image forming apparatus according to claim 1, wherein the second support member is configured to draw out of a main body of the image forming apparatus, wherein the image forming apparatus further comprises:

a main-body-side connector provided on a surface of the main body of the image forming apparatus opposite a back end surface of the second support member in a drawing out direction; and a fixing-side connector configured to draw out together with the second support member from the main body of the image forming apparatus and configured to connect to the main-body-side connector, and wherein the first support member supported by the second support member is configured to be rotationally moved around an axis portion by the adjustment unit to adjust the position of the first support member relative to the second support member, and the fixing-side connector is provided near the rotation axis portion of the first support member.

4. The image forming apparatus according to claim 3, wherein the adjustment unit includes a joining unit configured to join the first support member and the second support member, and the joining unit is provided on a near side in the drawing out direction of the first support member.

5. An image forming apparatus comprising:

an image conveying member configured to bear and convey a toner image;

a transfer member configured to transfer the toner image on the image conveying member to a sheet while nipping and conveying the sheet cooperatively with the image conveying member;

a fixing member configured to fix the toner image on the sheet; a motor configured to drive the fixing member to rotate; a first frame on which the fixing member and the motor are mounted;

a second frame on which the transfer member and the first frame are mounted, wherein the second frame is configured to draw out of a main body of the apparatus together with the first frame, and;

an adjusting mechanism configured to adjust a parallelism between the transfer member and the fixing member by rotating the first frame relative to the second frame around an axis.

6. The image forming apparatus according to claim 5, wherein the axis is disposed at an upstream end side of the first frame in a drawing direction of the second frame.

7. The image forming apparatus according to claim 6, further comprising a frame side connector provided on the first frame and configured to connect to a main body side connector to supply an electric energy to the motor, wherein said frame side connector is disposed adjacent to the axis.

8. The image forming apparatus according to claim 7, further comprising a power supply wire configured to connect the frame side connector and the motor.

9. The image forming apparatus according to claim 7, wherein the motor is disposed at a downstream end side of the first frame in a drawing direction of the second frame.

10. The image forming apparatus according to claim 9, further comprising a gear train provided on the first frame and configured to transmit a driving force from the motor to the fixing member.

11. The image forming apparatus according to claim 5, wherein the motor is disposed at a downstream end side of the first frame in a drawing direction of the second frame.

12. The image forming apparatus according to claim 1, further comprising a gear train provided on the first frame and configured to transmit a driving force from the motor to the fixing member.

13. The image forming apparatus according to claim 5, wherein the adjusting mechanism includes an arc-like hole formed on the first frame and a screw configured to fix the first frame and the second frame in the arc-like hole.

14. The image forming apparatus according to claim 13, wherein the second frame is configured to draw out of a main body of the apparatus together with the first frame, and wherein the arc-like hole is disposed at a downstream end side in a drawing direction of the second frame.

15. The image forming apparatus according to claim 5, further comprising a photosensitive member, wherein the image conveying member is an intermediate transfer member onto which the toner image is transferred from the photosensitive member.

16. The image forming apparatus according to claim 5, wherein the image conveying member is a photosensitive member.

17. The image forming apparatus according to claim 5, wherein the parallelism between the transfer member and the fixing member is a parallelism between a transfer nip in the transfer member and a fixing nip in the fixing member.

18. An image forming apparatus comprising: a photosensitive member;

an intermediate transfer member onto which a toner image is transferred from the photosensitive member;

a transfer member configured to transfer the toner image on the intermediate transfer member to a sheet while nipping and conveying the sheet cooperatively with the intermediate transfer member;

a fixing member configured to fix the toner image on the sheet; a motor configured to drive the fixing member to rotate; a first frame on which the fixing member and the motor are mounted;

a second frame on which the transfer member and the first frame are mounted, wherein the second frame is configured to draw out of a main body of the apparatus together with the first frame, and;

an adjusting mechanism configured to adjust a parallelism between a generatrix of the transfer member and a generatrix of the fixing member by rotating the first frame relative to the second frame around an axis.

19. The image forming apparatus according to claim 18, wherein the axis is disposed at an upstream end side of the first frame in a drawing direction of the second frame.

20. The image forming apparatus according to claim 19, further comprising a frame side connector provided on the first frame and configured to connect to a main body side connector to supply an electric energy to the motor, wherein said frame side connector is disposed adjacent to the axis.

21. The image forming apparatus according to claim 20, further comprising a power supply wire configured to connect the frame side connector and the motor.

22. The image forming apparatus according to claim 20, wherein the motor is disposed at a downstream end side of the first frame in a drawing direction of the second frame.

23. The image forming apparatus according to claim 22, further comprising a gear train provided on the first frame and configured to transmit a driving force from the motor to the fixing member.

24. The image forming apparatus according to claim 18, wherein the motor is disposed at a downstream end side of the first frame in a drawing direction of the second frame.

25. The image forming apparatus according to claim 24, further comprising a gear train provided on the first frame and configured to transmit a driving force from the motor to the fixing member.

26. The image forming apparatus according to claim 18, wherein the adjusting mechanism includes an arc-like hole formed on the first frame and a screw configured to fix the first frame and the second frame in the arc-like hole.

27. The image forming apparatus according to claim 26, wherein the second frame is configured to draw out of a main body of the apparatus together with the first frame, and wherein the arc-like hole is disposed at a downstream end side in a drawing direction of the second frame.

28. The image forming apparatus according to claim 18, further comprising a photosensitive member, wherein the image conveying member is an intermediate transfer member onto which the toner image is transferred from the photosensitive member.

* * * * *